US007070639B2

(12) United States Patent
Inoue et al.

(10) Patent No.: US 7,070,639 B2
(45) Date of Patent: Jul. 4, 2006

(54) CYCLONIC VACUUM CLEANER

(75) Inventors: Mineyuki Inoue, Niigata-ken (JP); Katsuhiko Yoshida, Niigata-ken (JP); Takeshi Yamada, Niigata-ken (JP)

(73) Assignee: Twinbird Corporation (JP)

( * ) Notice: Subject to any disclaimer, the term of this patent is extended or adjusted under 35 U.S.C. 154(b) by 657 days.

(21) Appl. No.: 10/404,383

(22) Filed: Apr. 1, 2003

(65) Prior Publication Data

US 2003/0200621 A1 Oct. 30, 2003

(30) Foreign Application Priority Data

Apr. 25, 2002 (JP) ..... 2002-123840

(51) Int. Cl.
*B01D 45/12* (2006.01)
*A47G 9/16* (2006.01)

(52) U.S. Cl. ..... 55/429; 55/447; 55/DIG. 3; 15/350; 15/353

(58) Field of Classification Search ..... 55/337, 55/429, 447, DIG. 3; 15/350, 353
See application file for complete search history.

(56) References Cited

U.S. PATENT DOCUMENTS 6,141,826 A * 11/2000 Conrad et al. ..... 15/347

FOREIGN PATENT DOCUMENTS

| | | |
|---|---|---|
| CA | 2061469 | 11/1996 |
| EP | 0 827 710 A2 | 3/1998 |
| GB | 2 373 996 A | 10/2002 |
| JP | 06-054778 | 3/1994 |
| JP | 2001-104223 A | 4/2001 |

* cited by examiner

*Primary Examiner*—Robert A. Hopkins
(74) *Attorney, Agent, or Firm*—Akerman Senterfitt

(57) ABSTRACT

A cyclonic vacuum cleaner with simple structure, low airflow leakage, excellent maintainability, and less possibility of littering a floor in the case of dumping dusts or care of the cleaner. A cyclonic portion 14 of an approximately cylindrical shape, having a bottom, an introducing portion 15 for introducing dust-laden airflow to the cyclonic portion 14, and a reinforcing rib 35 provided on a lowermost end of the dust-collecting portion 11 for allowing it to stand on end, are formed into a one-piece structure. Thus, the structure from the introducing portion 15 to the cyclonic portion 14 can be simplified and the possibility of airflow leakage can be reduced. Also, maintenance of the cyclonic portion 14 and the introducing portion 15 can be easily performed through the detachment of the dust-collecting portion 11 together with the introducing portion 15. Further, a floor is less likely to be littered with dusts collected within the cyclonic portion 14 by allowing the dust-collecting portion 11 to stand on end with the help of the reinforcing rib 35.

12 Claims, 11 Drawing Sheets

CYCLONIC VACUUM CLEANER

BACKGROUND OF THE INVENTION

1. Field of the Invention

The present invention relates to a cyclonic vacuum cleaner, particularly to a stick type one.

2. Description of the Related Art

One of conventional cyclonic vacuum cleaners of this type is disclosed in, for example, Japanese Un-Examined patent publication No. 2001-104223. The disclosed vacuum cleaner comprises a cleaner body including a built-in fan motor, a suction passage (an introducing portion) provided in its rear portion and a suction opening (a sucking nozzle) provided in its lower portion, wherein a dust box (a cyclonic portion), having a bottom and an intake hole formed tangentially on a sidewall, is detachably attached to the cleaner body. By actuating the motor fan, a dust-laden air is sucked from the suction opening and then flows through the suction passage and the intake hole to reach the inside of the dust box where it is converted into a vortex flow, so that the dust is separated by a centrifugal force developed inside the dust box. According to such conventional cyclonic vacuum cleaners, the dust box is formed slenderer in the top to bottom direction, so that dust-collecting performance can be improved due to the rotational speed of the vortex flow being higher as it goes downward.

According to such conventional cyclonic vacuum cleaners, however, as dust-laden air must be introduced from an upper side of the dust box, the suction passage from the suction opening to the dust box would inevitably become lengthy, thus resulting not only in a complex structure of the vacuum cleaner as a whole, but also in the increased number of components that eventually leads to high manufacture costs, even leading to a likelihood of airflow leakage to occur in joints between such increased components.

Further, when film-like or clumpy dusts are sucked, for instance, the suction passage may happen to be clogged with such dusts, thus causing a problem of poor maintainability due to a difficulty in removing such dusts caught in the suction passage. Still further, in the case that the dust box is formed slenderer in the top to bottom direction to improve the dust-collecting performance, the floor that has been already cleaned is likely to be littered with the dusts again as the dust box has to be temporarily laid down on the floor when users let go hold of it in the case of detaching it from the cleaner body to dump the dusts or doing maintenance on the vacuum cleaner.

SUMMARY OF THE INVENTION

To eliminate the above-mentioned problems, it is, therefore, an object of the present invention to provide a cyclonic vacuum cleaner which has a simple structure, and causes little airflow leakage despite a long suction passage.

It is another object of the present invention to provide a cyclonic vacuum cleaner which is less likely to litter floors when removing collected dusts or doing maintenance works to the same.

A cyclonic vacuum cleaner according to a first aspect of the invention is a cyclonic vacuum cleaner including a cleaner body with a motor fan unit and a dust-collecting portion detachably attached to the cleaner body, wherein the dust-collecting portion comprises: a cyclonic portion which is formed approximately cylindrical, having a bottom; an introducing portion for introducing a dust entraining airflow into said cyclonic portion; a leg provided integrally with a lowermost end of the dust-collecting portion for allowing the dust-collecting portion to stand on end; and a sucking nozzle detachably attached to said introducing portion, wherein the cyclonic portion, the introducing portion and the leg are formed integrally with one another.

With the structure thus made, the airflow sucked from the sucking nozzle is allowed to pass through the introducing portion of the dust-collecting portion, and then it is introduced into the cyclonic portion formed integrally with the introducing portion, so that it is converted into a vortex flow within the cyclonic portion, whereby it is discharged to the outside of the cleaner body through the motor fan unit after the dusts are separated by a centrifugal force developed inside the dust box. The dusts collected in the cyclonic portion can be dumped by detaching the dust-collecting portion together with the introducing portion. Further, the leg enables the dust-collecting portion to temporarily stand on end in the case of dumping dusts, or in the case of the maintenance or care of the dust-collecting portion.

A cyclonic vacuum cleaner according to a second aspect of the invention is the one set forth in the first aspect, in which the leg is formed by a reinforcing rib which connects the cyclonic portion with the introducing portion, the reinforcing rib being so structured that at least a lower surface thereof being formed substantially horizontal, and that a projection point obtained by projecting the center of gravity of the dust-collecting portion in the vertical direction may be positioned on the reinforcing rib.

With the structure thus made, the dust-collecting portion is placed in a manner that the lower surface of the reinforcing rib contacts a flat surface, and thus the projection point of the center of gravity of the dust-collecting portion is positioned on the reinforcing rib, thus keeping the dust-collecting portion stably standing on end.

A cyclonic vacuum cleaner according to a third aspect of the invention is the one set forth in the first or the second aspect, in which a lower end of the leg is flush with a lower end of the introducing portion and/or a lower end of the cyclonic portion.

Thus, as the dust-collecting portion is supported not only by the leg but also by the introducing portion and/or the cyclonic portion, it is possible to keep the dust-collecting portion more stably standing on end.

A cyclonic vacuum cleaner according to a fourth aspect of the invention is the one set forth in any one of the first to third aspects, in which a lower end of the leg is flush with a lower end of the introducing portion while a projection point obtained by projecting the center of gravity of the dust-collecting portion in the vertical direction is positioned in a region surrounded by the lower end of the leg and the lower end of the introducing portion.

With the structure thus made, as the dust-collecting portion is supported not only by the leg but also by the introducing portion and the cyclonic portion, with the projection point obtained by projecting the center of gravity of the dust-collecting portion being in the region surrounded by the lower end of the leg and the lower end of introducing portion, it is possible to keep the dust-collecting portion standing on end in an even more stable manner.

BRIEF DESCRIPTION OF THE DRAWINGS

For a more complete understanding of the present invention, reference is now made to the following description taken in conjunction with the accompanying drawings, in which.

DESCRIPTION OF THE PREFERRED EMBODIMENTS

Hereunder is a description of a first embodiment of the present invention with reference to FIG. 1 to FIG. 8. In the following description of the embodiment, front and back of the vacuum cleaner as well as top and bottom thereof are defined on the basis of the posture illustrated in FIG. 1 to FIG. 3.

Figure 1:
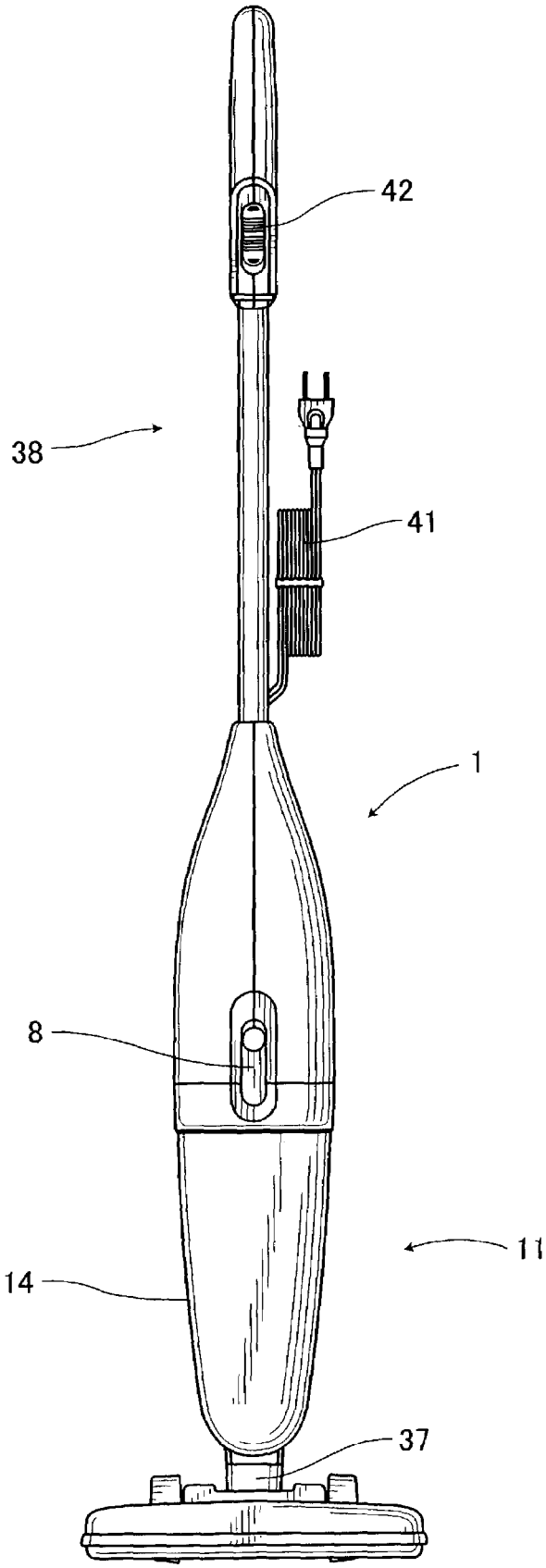
FIG. 1 is a front view showing a cyclonic vacuum cleaner according to a first embodiment of the present invention.
Figure 2:
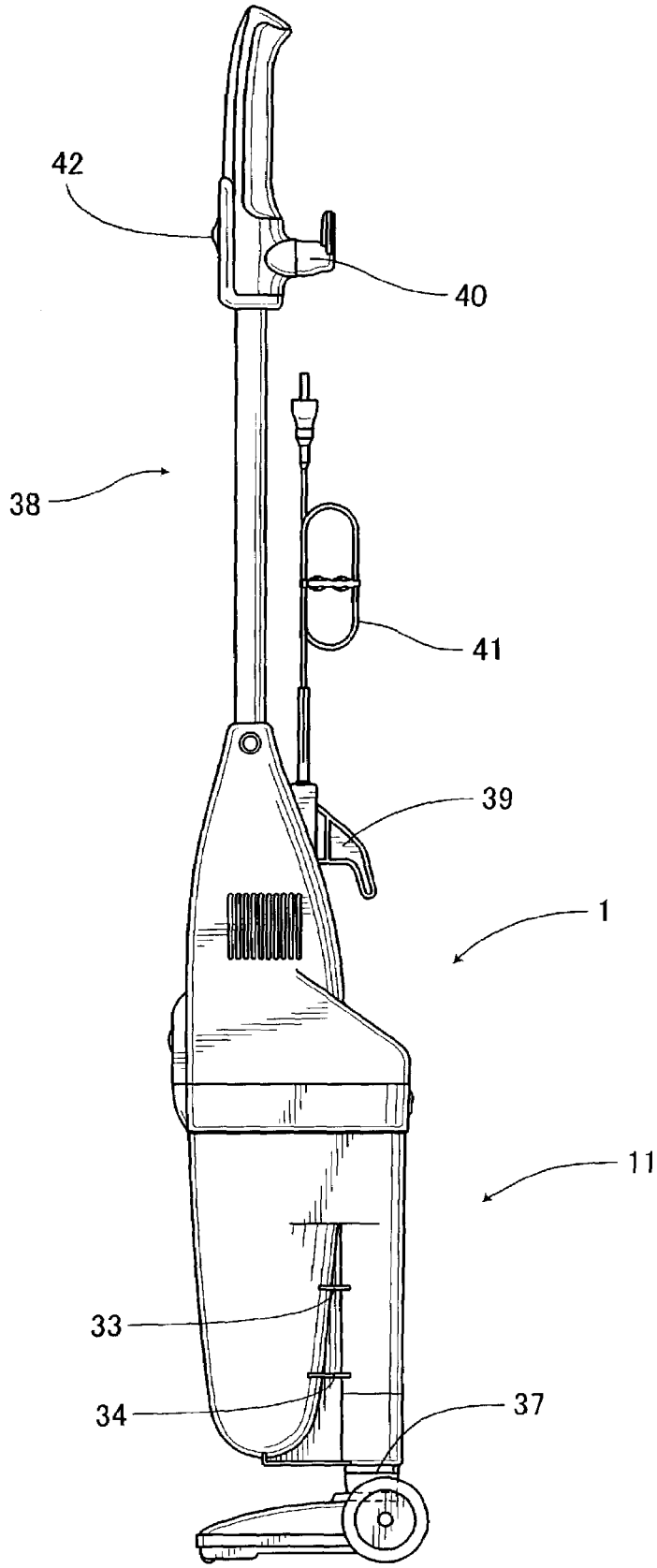
FIG. 2 is a side view of the cyclonic vacuum cleaner of FIG. 1.
Figure 3:
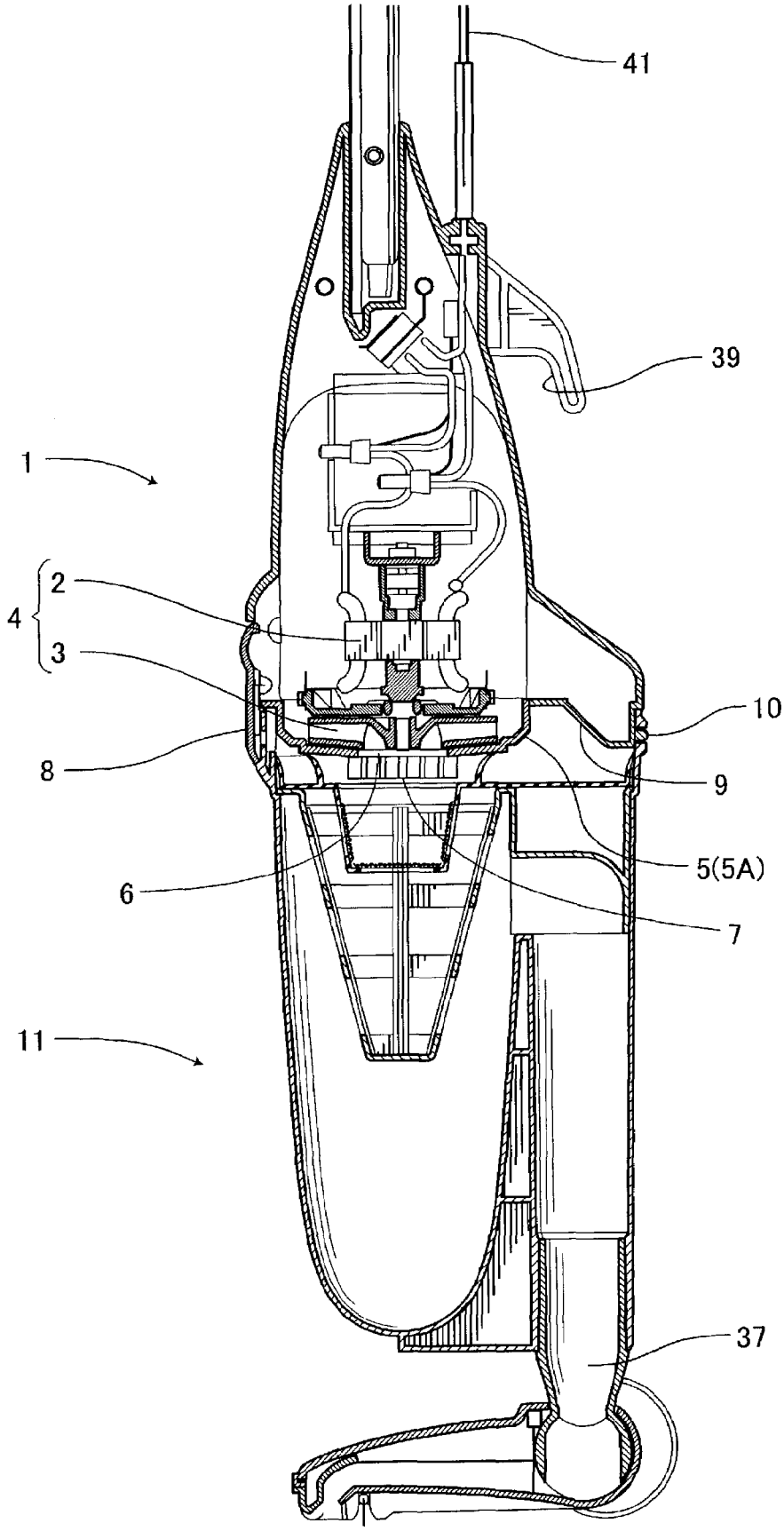
FIG. 3 is a partly enlarged cross-sectional view of the cyclonic vacuum cleaner of FIG. 1.
Figure 4:
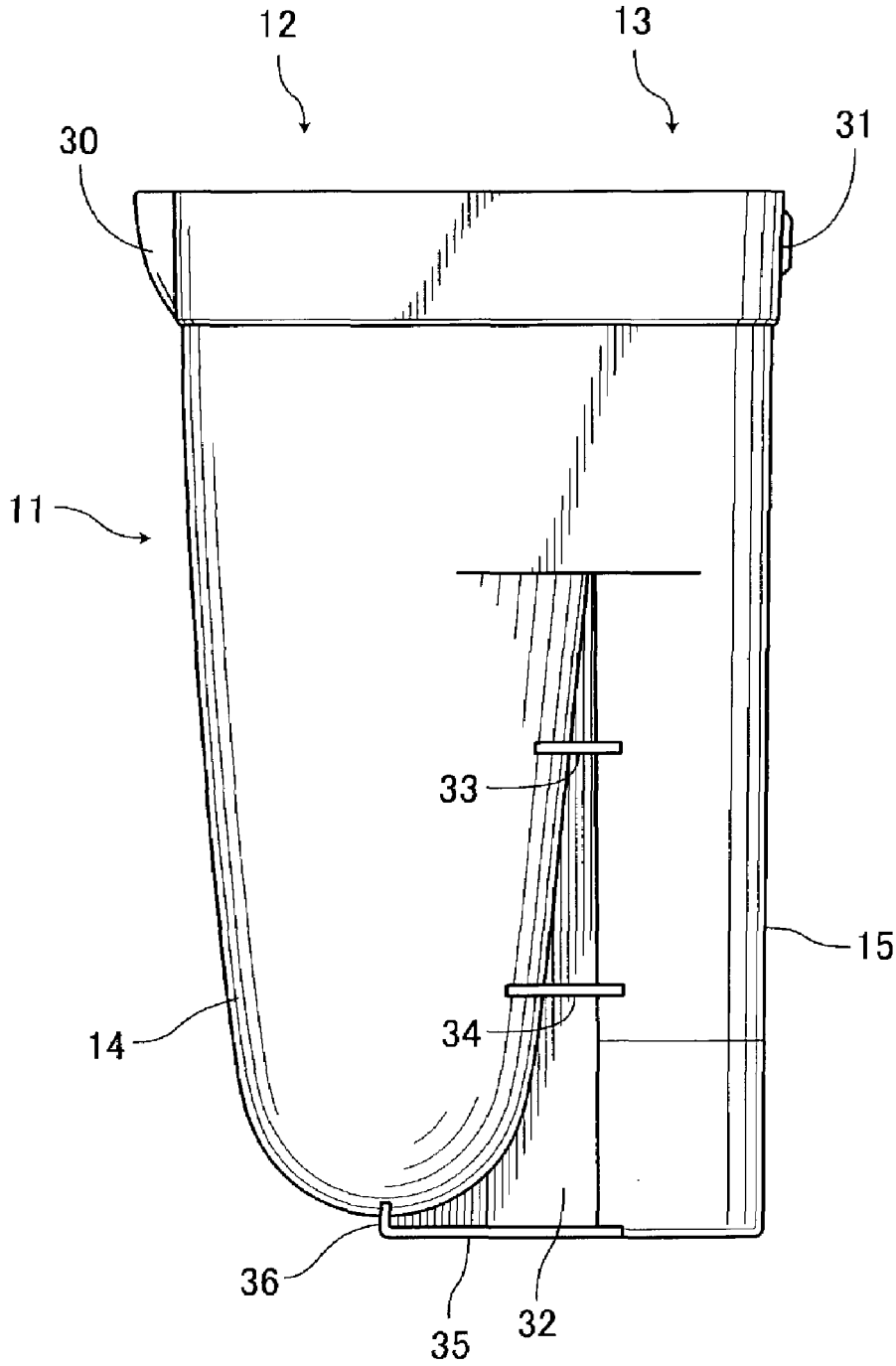
FIG. 4 is a side view of a dust-collecting portion of the cyclonic vacuum cleaner of FIG. 1.
Figure 5:
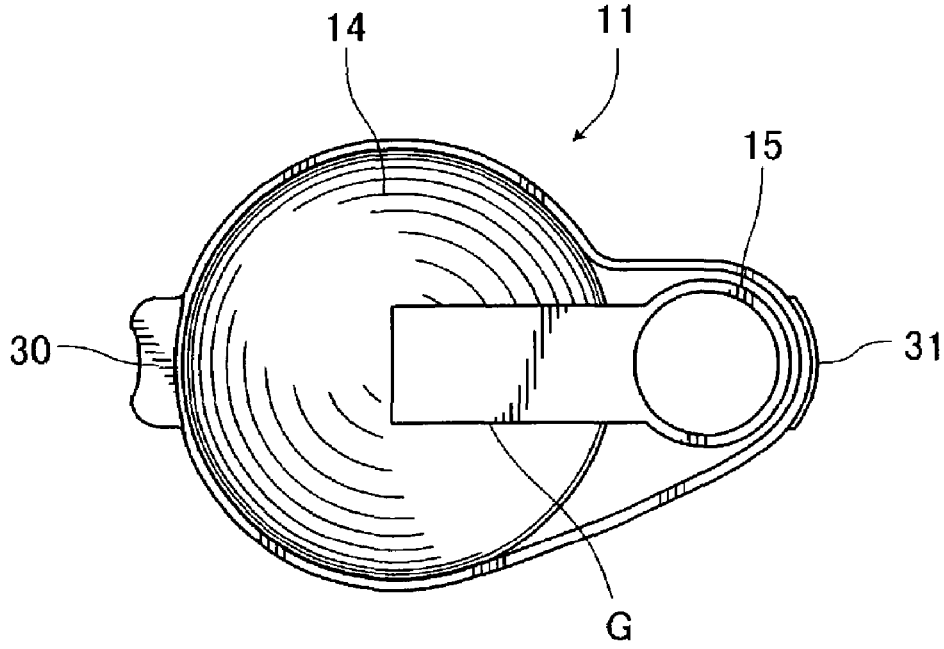
FIG. 5 is a bottom view of the dust-collecting portion of the cyclonic vacuum cleaner of FIG. 1.
Figure 6:
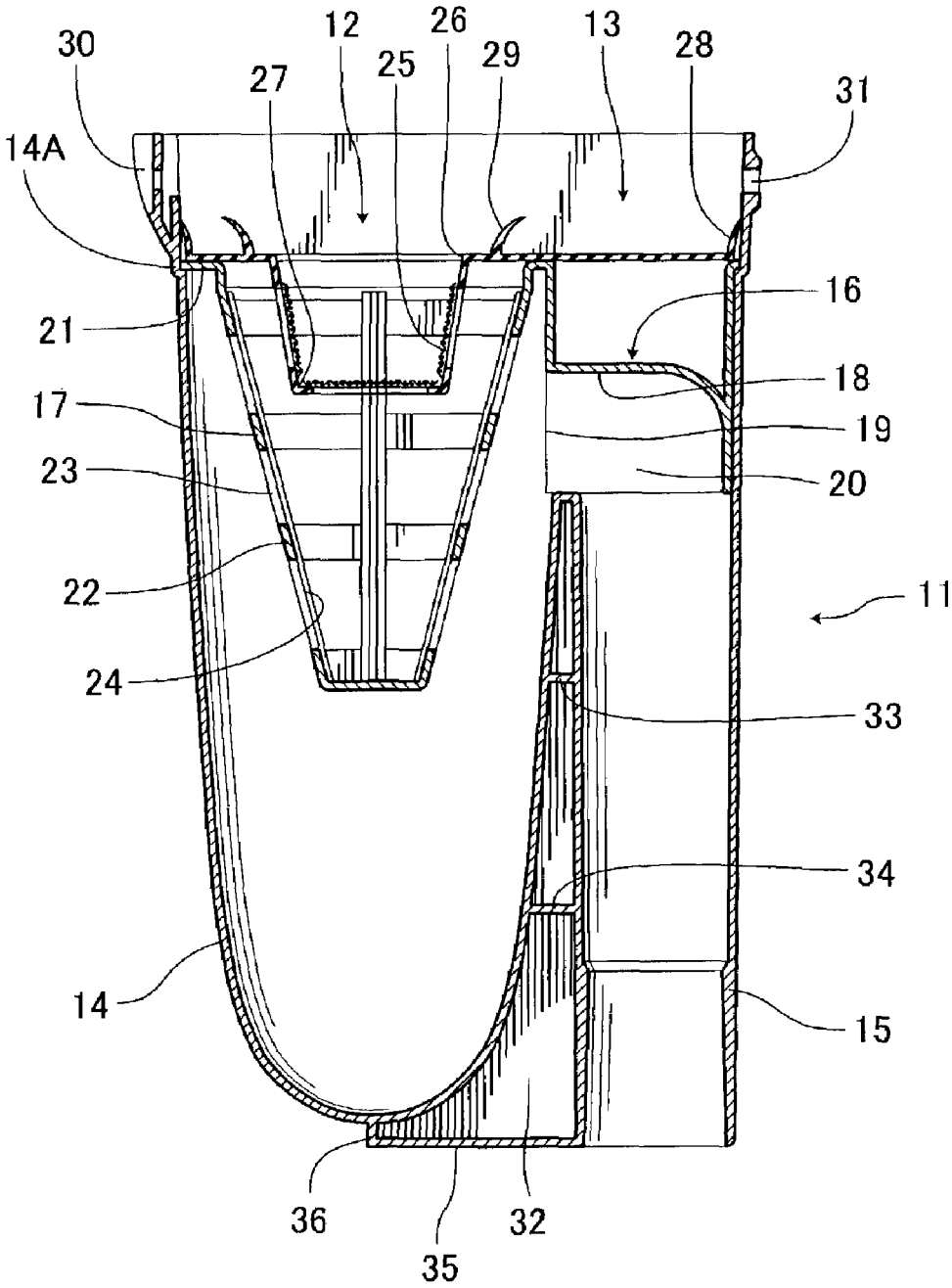
FIG. 6 is a longitudinal section taken along the front-to-back direction of the dust-collecting portion of the cyclonic vacuum cleaner of FIG. 1.
Figure 7:
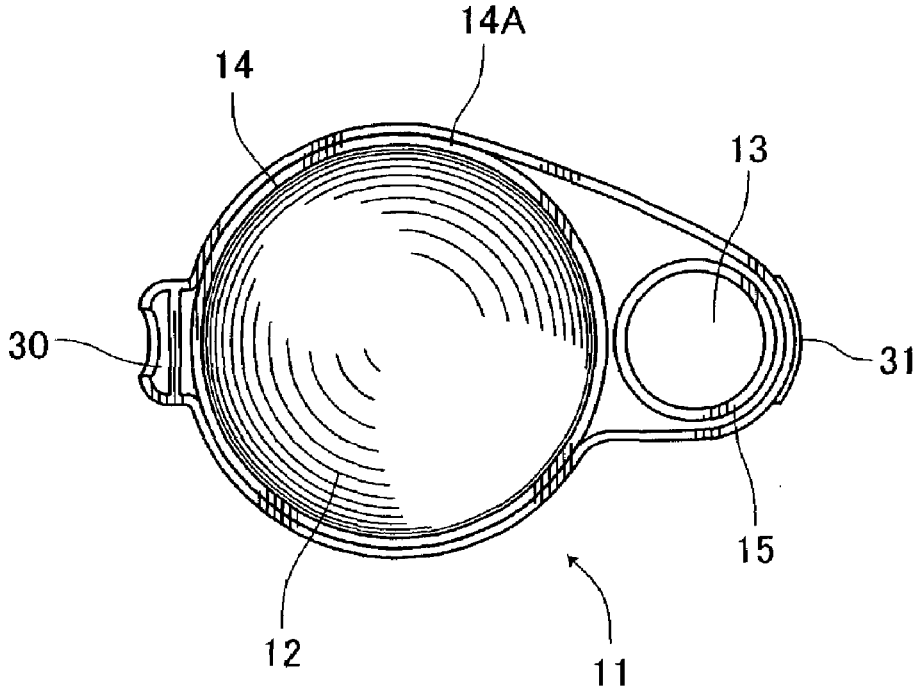
FIG. 7 is a top plan view of the dust-collecting portion of the cyclonic vacuum cleaner of FIG. 1.
Figure 8:
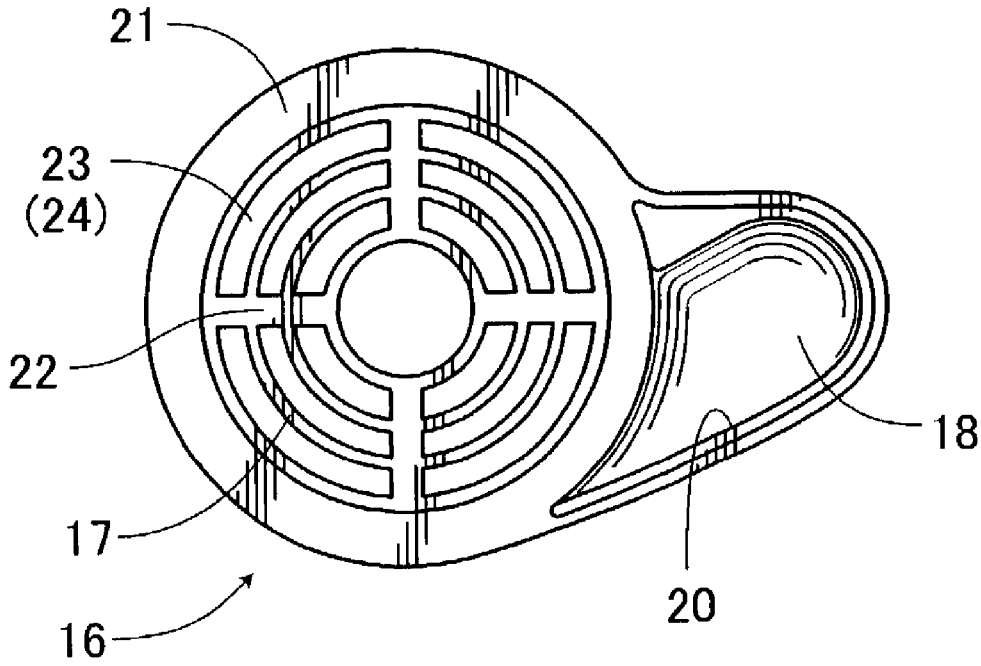
FIG. 8 is a bottom view of a vortex flow generating member of the cyclonic vacuum cleaner of FIG. 1.

In FIG. 1 to FIG. 3, numeral 1 denotes a cleaner body. Inside the cleaner body 1 are provided an electric motor 2 and a fan 3 fitted to a rotating shaft of the electric motor 2, thus constructing a motor fan unit 4. In a lower portion of the cleaner body 1 is provided a guide portion 5 which has an approximately short cylindrical shape, including a flat lower end portion 5A. The guide portion 5 is formed with an intake hole 6 which is open downward, so that a lower portion of the guide portion 5 is communicated with the motor fan unit 4 through the intake hole 6. Further, the guide portion 5 is formed with a protective frame 7 so as to cover the intake hole 6. A movable hook 8 is provided on a front side of the guide portion 5, while a convex portion 9 protruding downward is formed on a rear side of the guide portion 5, with a fixed hook 10 protruding backward being formed on a side face of the convex portion 9. Thus, the cleaner body 1 is constructed so as to have such a simple structure as above described.

A dust-collecting portion 11 made of resin is detachably attached to a lower portion of the cleaner body 1. The dust-collecting portion 11 is formed on its top with a first opening 12 for inserting the guide portion 5 thereinto and a second opening 13 for inserting the convex portion 9 thereinto. Below the first opening 12 is formed a cyclonic portion 14 which is of an approximately cylindrical shape, being tapered toward a lower end having a bottom, while below the second opening 13 is formed an introducing portion 15 which has an cylindrical inside surface, extending substantially in parallel with an axial direction of the cyclonic portion 14. The cyclonic portion 14 and the introducing portion 15 are formed integrally from a common member, with a lower end of the introducing portion 15 being slightly lower than that of the cyclonic portion 14.

Further, a vortex flow generating member 16 serving as a vortex flow generating means is provided in the first and second openings 12 and 13. The vortex flow generating member 16 includes a conical portion 17 which is approximately inverted-cone-shaped, and an introducing wall 18 leading to the conical portion 17, in which the conical portion 17 and the introducing wall 18 are formed integrally from a common member. The vortex flow generating member 16 is detachably attached to the dust-collecting portion 11 so that the conical portion 17 may correspond to the first opening 12, and the introducing wall 18 may correspond to the second opening 13, respectively.

As the introducing wall 18 is provided between the introducing portion 15 and the second opening 13, the upper end of the introducing portion 15 is closed while an introducing opening 19 is formed on a sidewall between an upper portion of the cyclonic portion 14 and the vicinity of the upper end of the introducing portion 15. In the meantime, the introducing wall 18 is formed so as to define a smoothly curved surface in order to smoothly turn the direction of airflow ascending through the introducing portion 15 perpendicularly to the axis of the introducing portion 15 to thereby introduce the airflow from the introducing opening 19 into the cyclonic portion 14. The introducing opening 19 is so constructed that it may be open to the tangential direction of one side of the sidewall in the cyclonic portion 14. More specifically, an introducing sidewall 20, i.e., a side face of the introducing wall 18 is constructed so that the introducing portion 15 may be connected substantially linearly with the tangential direction of one side of the cyclonic portion 14. Accordingly, the airflow ascending through the introducing portion 15 is urged toward the tangential direction of the one side of the sidewall in the cyclonic portion 14.

The conical portion 17 comprises: a flange portion 21 mounted on a step portion 14A between the first opening 12 and the cyclonic portion 14; a conical base portion 22 formed integrally with the flange portion 21; a ventilating hole 23 provided on a side face of the base portion 22; and a filter 24 provided in the ventilating hole 23. A filter member 26 including a pouched filter 25 is provided on an upper portion of the vortex flow generating member 16. The filter member 26 has a frame 27 formed from flexible resin or rubber while a seal portion 28 formed around an outer periphery of the frame 27 is so constructed that it may be able to closely contact the inner peripheries of the first opening 12 and the second opening 13. Further, a lip portion 29 is formed on a top portion of the frame 27 and is so constructed that it may be able to closely contact the lower end 5A of the guiding portion 5 in a manner that the lip portion 29 surrounds the intake hole 6, when the dust-collecting portion 11 with the vortex flow generating member 16 and the filter member 26 is attached to the cleaner body 1.

Furthermore, a first receiving portion 30 which engages with the movable hook 8 is formed on a front side of the first opening 12 while a second receiving portion 31 which engages with the fixed hook 10 is formed on a rear side of the second opening 13. In the meantime, reference symbol 32 denotes a rib vertically provided between the cyclonic portion 14 and the introducing portion 15, said vertical rib 32 being integrally formed with reinforcing ribs 33, 34 and 35 arranged horizontally. By the rib 32 as well as the reinforcing ribs 33, 34 and 35, the stiffness of the dust-collecting portion 11 is enhanced.

In the meantime, the reinforcing rib 35 is provided on a lower end of the rib 32, while another reinforcing rib 36 is formed in a manner that is formed by bending the front end of the reinforcing rib 35, said reinforcing rib 36 extending in an orthogonal direction relative to the rib 32 and the reinforcing rib 35. The reinforcing rib 36 is integrally combined with the center of the lower end of the cyclonic portion 14. The reinforcing rib 35 has a lower end formed flush with that of the introducing portion 15 so that the dust-collecting portion 11 is able to stand on end owing to the introducing portion 15 and the reinforcing rib 35 when the dust-collecting portion 11 is detached from the cleaner body 1. The dust-collecting portion 11 is structured such that a projection point G obtained by projecting the center of gravity of the dust-collecting portion 11 in the vertical direction may be positioned on the reinforcing rib 35. As such, the structure of the dust-collecting portion 11 is simplified thus way. Incidentally, a nozzle 37 serving as a sucking nozzle is detachably attached to a lower end of the introducing portion 15.

Reference numeral 38 denotes a handle attached to the cleaner body 1 in a detachable manner. Further, hooks 39, 40 are formed on the cleaner body 1 and the handle 38, respectively, allowing a power cord 41 extending from a portion of the cleaner body 1 between these hooks 39, 40 to be wound around them. Further, a power switch-operating portion 42 is provided on the handle 38.

Next is a description of the behaviors of a cyclonic vacuum cleaner according to the present embodiment. In the first place, users attach the vortex flow generating member 16 and the filter member 26 to the first opening 12 and the second opening 13 of the dust-collecting portion 11. At that moment, the seal portion 28 of the filter member 26 contacts closely the inner walls of the first opening 12 and the second opening 13. Then, after allowing the second receiving portion 31 of the dust-collecting portion 11 to engage with the fixed hook 10, the first receiving portion 30 is allowed to engage with the movable hook 8, so that the dust-collecting portion 11 is attached to the cleaner body 1. At that moment, the guide portion 5 is inserted into the first opening 12 and the convex portion 9 is also inserted into the second opening 13, so that the dust-collecting portion 11 is properly positioned relative to the cleaner body 1. Further, the lip portion 29 of the filter member 26 contacts closely the lower end 5A of the guide portion 5 in a manner that surrounds the intake hole 6. Accordingly, a path from the inside of the cyclonic portion 14 to the intake hole 6 is sealed. Then, the nozzle 37 is attached to the lower end of the introducing portion 15. It should be noted herein that the dust-collecting portion 11 not only allows the cyclonic portion 14 to be integrally connected with the introducing portion 15 by the rib 32, but also it is reinforced by the reinforcing ribs 33, 34, 35 and 36, so that the distortion of the dust-collecting portion 11 can be prevented during the use of the cleaner.

Then, the power cord 41 is detached from the hooks 39, 40 so that it is connected to a power receptacle (not shown), and then the power switch-operating portion 42 is operated so that the motor fan unit 4 is actuated. Then, dust-laden airflow is sucked from the nozzle 37 by the actuation of the motor fan unit 4. The airflow sucked from the nozzle 37 is then allowed to rise within the introducing portion 15, changing its flowing direction so as to flow along the introducing wall 18 of the vortex flow generating member 16 at an upper end of the introducing portion 15, so that the airflow is introduced from the introducing opening 19 into the cyclonic portion 14, along the tangential direction of the one side of the sidewall of the cyclonic portion 14.

The airflow thus introduced into the cyclonic portion 14 is converted into a vortex flow along an inner peripheral surface of the cyclonic portion 14 so that the vortex flow descends spirally. At that moment, dusts contained in the vortex flow are pressed to an inner peripheral surface of the cyclonic portion 14 by centrifugal force. Then, when the vortex flow reaches a bottom of the cyclonic portion 14, the vortex flow having been descending on the side of the inner peripheral surface of the cyclonic portion 14 in turn starts rising in the vicinity of the center portion of the cyclonic portion 14. At that moment, as the dusts contained in the vortex flow are pressed to the inner peripheral surface of the cyclonic portion 14 by centrifugal force as described above, comparatively rough dusts are allowed to stay in the vicinity of the inner peripheral surface of the cyclonic portion 14 so that they are separated from the vortex flow, even if the vortex flow flows toward the vicinity of the center of the cyclonic portion 14 from the side of the inner peripheral surface thereof.

On the other hand, comparatively fine dusts, which are being mixed in the vortex flow, are moved to the vicinity of the center of the cyclonic portion 14 and start to ascend in the cyclonic portion 14 in association with the rising of the vortex flow. Then, the ascended vortex flow passes through the ventilating hole 23 formed on a side face of the vortex flow generating member 16 positioned at the upper portion. At that moment, comparatively fine dusts contained in the vortex flow are captured by the filter 24 attached to the ventilating hole 23, while still finer dusts having passed through the filter 24 are captured by a filter 25 of a filter member 26 provided on an upper portion of the vortex flow generating member 16. Airflow which has passed through the filter 24 of the vortex flow generating member 16 and the filter 25 of the filter member 26 reaches the motor fan unit 4 through the intake hole 6 to eventually go out of the cleaner body 1.

After cleaning, the nozzle 37 is detached from a lower end of the introducing portion 15 and then the dust-collecting portion 11 is detached from the cleaner body 1 by operating the movable hook 8. Then, the filter member 26 and the vortex flow generating member 16 are detached from the first opening 12 and the second opening 13, thus removing dusts adherent to the filters 24, 25. The dusts collected in the cyclonic portion 14 are dumped into a trash box. At this moment, as the cyclonic portion 14 is formed integrally with the introducing portion 15 in the dust-collecting portion 11, not only can the dusts within the cyclonic portion 14 be easily dumped but also can those collected in the introducing portion 15 be easily removed with the light dust-collecting portion 11 being held by a hand. Accordingly, even if sheet-like matter or the like is sucked so that the introducing portion 15 or introducing opening 19 is clogged therewith during cleaning, yet it can be easily removed.

Specifically, as the vortex flow generating member 16 having the introducing wall 18 is detachable from the dust-collecting portion 11 so that the introducing portion 15 penetrates from top through bottom when the vortex flow generating member 16 is detached, it is easy to remove those which clog the introducing portion 15, thus displaying excellent maintainability. Further, as the dust-collecting portion 11 is made of resin and is formed into one-piece structure, it can be washed with water, so that the cyclonic portion 14 and the introducing portion 15 can be kept cleaner through such wet-washing.

Moreover, as the dust-collecting portion 11 not only allows the cyclonic portion 14 to be integrally connected with the introducing portion 15 by the rib 32, but also it is reinforced by the reinforcing ribs 33, 34, 35 and 36, so that the damage to the dust-collecting portion 11 can be prevented when detaching it from the cleaner body 1. Still further, as the reinforcing rib 35 provided at the lower end of the dust-collecting portion 11 is flush with that of the introducing portion 15 while the point G obtained by projecting the center of gravity of the dust-collecting portion 11 in the vertical direction is positioned on the reinforcing rib 35, so that the dust-collecting portion 11 is able to stand on end on the lower end of the introducing portion 15 and the reinforcing rib 35 with the first opening 12 and the second opening 13 facing upward. Accordingly, it is possible to temporarily let the dust-collecting portion 11 stand on end without littering the floor with the dusts when dumping the dusts or the like, and thus it is very convenient. It should be noted that the dust-collecting portion 11 enables the dumping of the dusts with the nozzle 37 being attached to the lower end of the introducing portion 15, while the dust-collecting portion 11 is able to be put on end with the nozzle 37 being attached to the lower end of the introducing portion 15.

As described above, a cyclonic vacuum cleaner according to the present embodiment comprises the cleaner body 1 with the motor fan unit 4 and the dust-collecting portion 11 detachably attached to the cleaner body 1, wherein the dust-collecting portion 11 comprises: the cyclonic portion 14 which is approximately cylinder-shaped, having a bottom; the introducing portion 15 for introducing dust-laden airflow into the cyclonic portion 14; the reinforcing rib 35 serving as a leg for allowing the dust-collecting portion 11 to stand on end, said reinforcing rib 35 being provided on the lowermost end of the dust-collecting portion 11 so as to form the dust-collecting portion 11 into one-piece structure together with the cyclonic portion 14 and the introducing portion 15; and the nozzle 37 serving as a sucking nozzle detachably attached to said introducing portion 15.

Hence, airflow sucked from the nozzle 37 passes through the introducing portion 15 of the dust-collecting portion 11 to thereby be introduced into the cyclonic portion 14 formed integrally with the introducing portion 15, so that it is converted into a vortex flow within the cyclonic portion 14, whereby dusts are separated therefrom by centrifugal force and then the airflow passes through the motor fan unit 4 to be discharged to the outside of the cleaner body 1.

The dusts collected in the cyclonic portion 14 are dumped by detaching the dust-collecting portion 11 together with the introducing portion 15. Accordingly, not only can the structure of the cleaner body 1 be simplified despite the fact that a cyclonic vacuum cleaner tends to become too complex in structure, but the maintenance of the introducing portion 15 as well as that of the cyclonic portion 14 can be easily performed since dusts collected in the cyclonic portion 14 can be dumped through the detachment of the dust-collecting portion 11 together with the introducing portion 15. Further, as the structure from the introducing portion 15 to the cyclonic portion 14 is simplified thus way and therefore the number of components can be decreased, it is possible to reduce the manufacturing costs, and to reduce the possibility of airflow leakage that might take place in a suction passage, thereby enabling the enhancement of the dust-collecting performance.

Still further, if the dust-collecting portion 11 is temporarily laid down on the floor when users let go hold of it in the case of detaching it from the cleaner body 1 to dump the dusts or doing maintenance on the dust-collecting portion 11, yet the dust-collecting portion 11 can be allowed to stand on end by the reinforcing rib 35 serving as a leg, thus reducing the probability that the floor is littered with the dusts collected inside the cyclonic portion 14.

Specifically, the cyclonic vacuum cleaner of the invention comprises the leg formed by the reinforcing rib 35 which connects the cyclonic portion 14 with the introducing portion 15, said reinforcing rib 35 being so structured that at least the lower end thereof being formed substantially horizontal, and that the point G obtained by projecting the center of gravity of the dust-collecting portion 11 in the vertical direction may be positioned on the reinforcing rib 35. Thus, the dust-collecting portion 11 can be prevented from being distorted owing to the reinforcing rib 35 during the use of the cleaner. Also, if users temporarily let go hold of the dust-collecting portion 11 in the case of detaching it from the cleaner body 1 to dump the dusts or doing maintenance on the dust-collecting portion 11, yet the dust-collecting portion 11 can be allowed to stand on end by the reinforcing rib 35 serving as a leg, thus reducing the probability that the floor is littered with the dusts collected inside the cyclonic portion 14.

Still also, as the reinforcing rib 35 has the lower end formed flush with that of the introducing portion 15, the dust-collecting portion 11 is able to be supported not only by the reinforcing rib 35 but also by the lower end of the introducing portion 15, thus enlarging a support area for the dust-collecting portion 11, making it possible to keep the standing posture of the dust-collecting portion 11 more stably.

Figure 9:
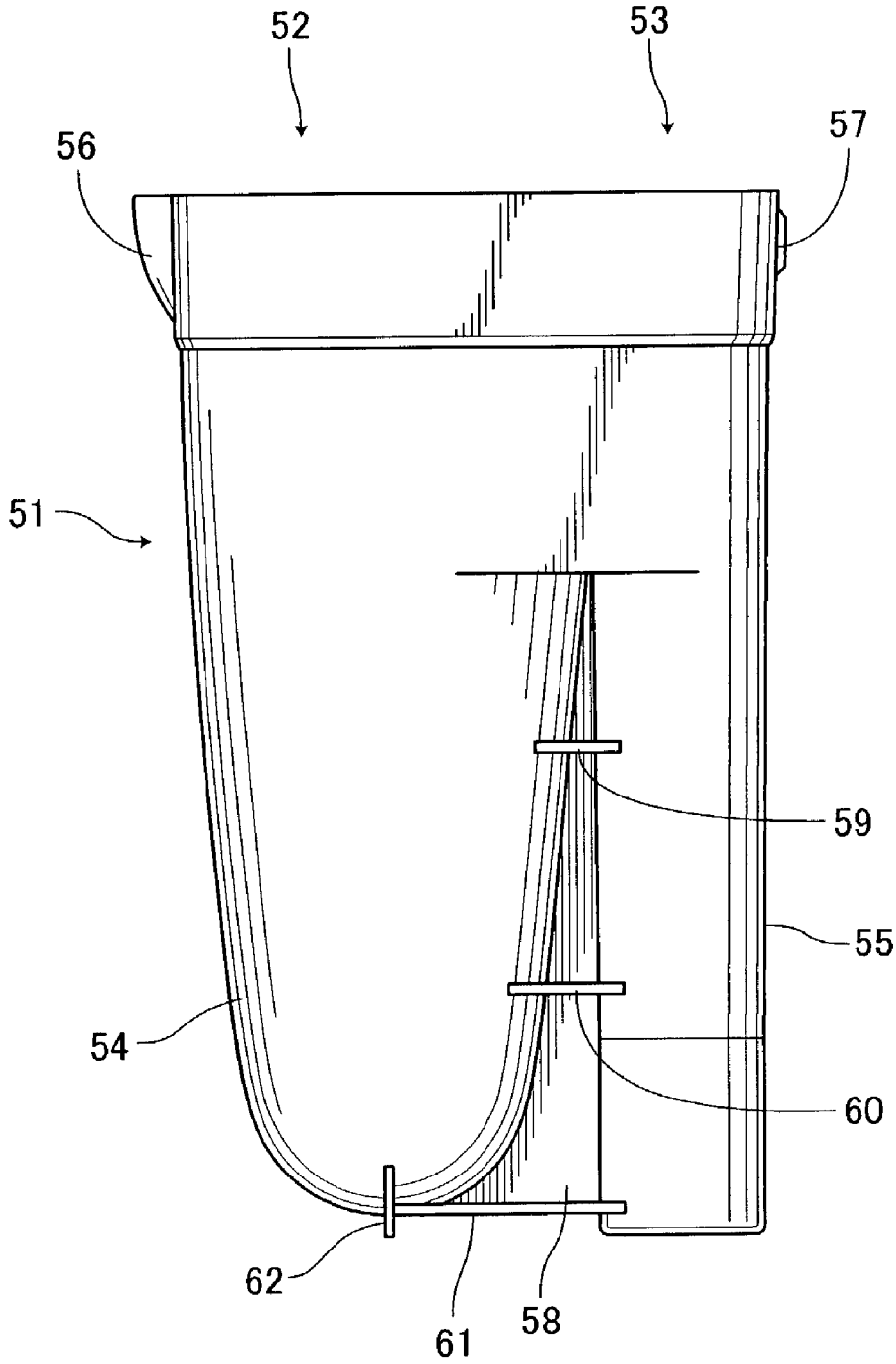
FIG. 9 is a side view of a dust-collecting portion of the cyclonic vacuum cleaner according to a second embodiment of the present invention.
Figure 10:
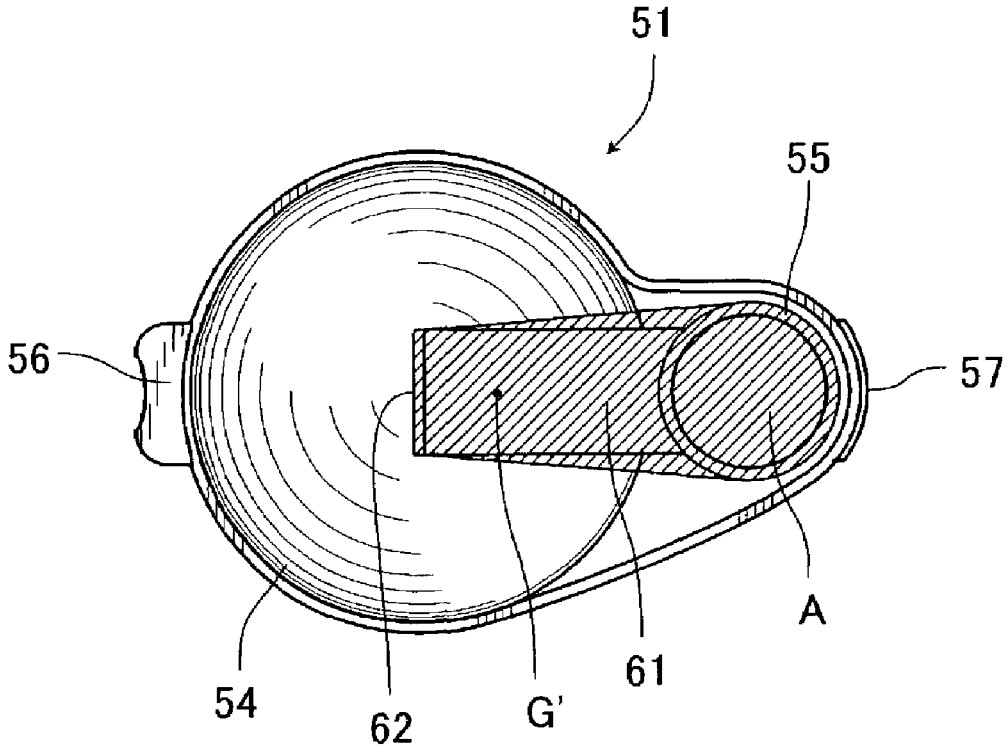
FIG. 10 is a bottom view of the dust-collecting portion of FIG. 9.
Figure 11:
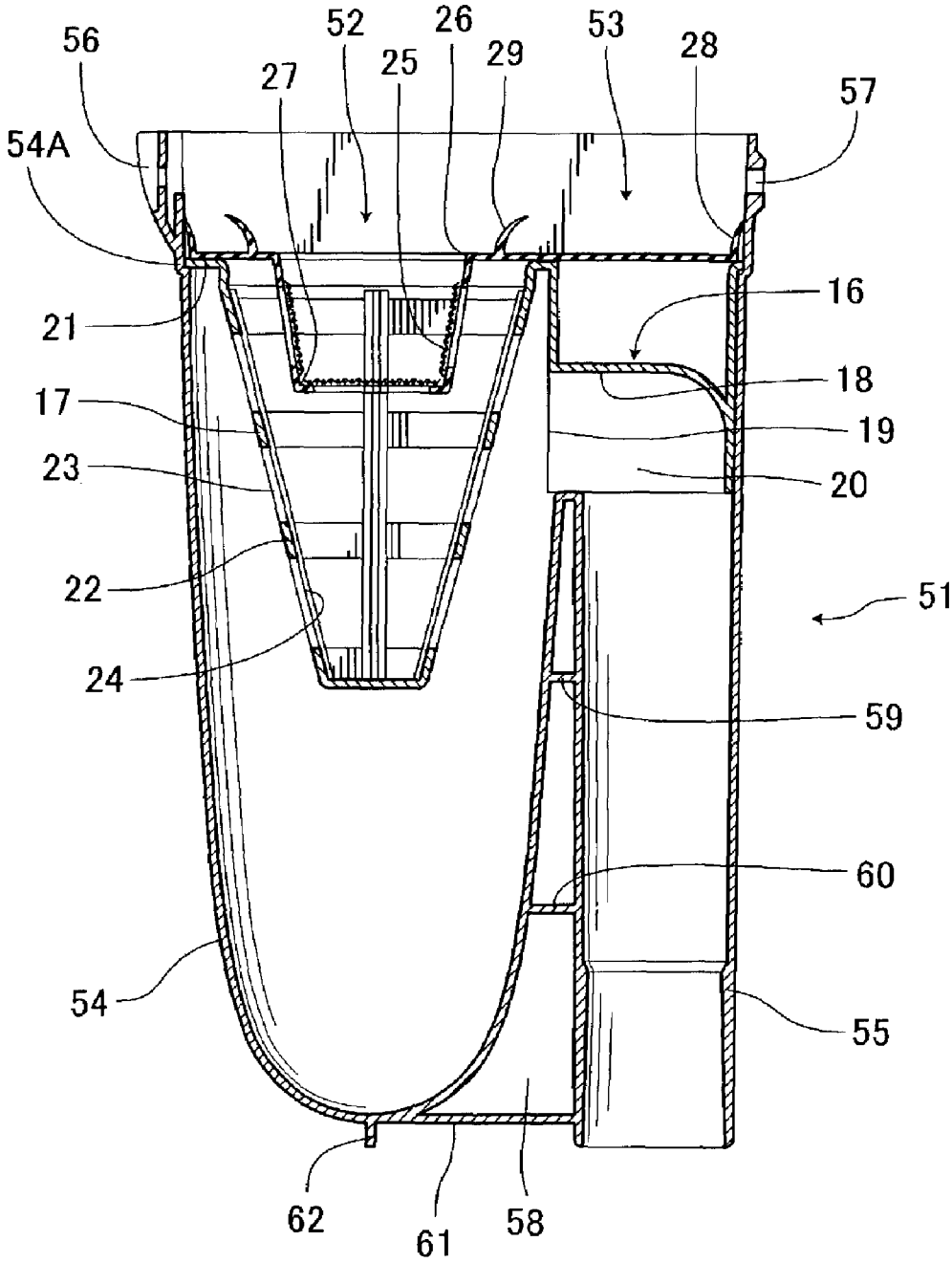
FIG. 11 is a longitudinal section taken along the front-to-back direction of the dust-collecting portion of FIG. 9.

Next is a description of a second embodiment of the present invention with reference to FIG. 9 to FIG. 11, in which the same reference symbols are used for the same parts as those described in the first embodiment, and their repeated detailed description thereof are omitted.

A dust-collecting portion 51 made of resin is detachably attached to a lower portion of the cleaner body 1. The dust-collecting portion 51 is formed at its upper portion with a first opening 52 for inserting the aforesaid guide portion 5 thereinto and a second opening 53 for inserting the convex portion 9 thereinto. Below the first opening 52 is formed a cyclonic portion 54 which is of an approximately cylindrical shape, being tapered toward a lower end having a bottom, while below the second opening 53 is formed an introducing portion 55 which has an cylindrical inside surface, extending substantially in parallel with an axial direction of the cyclonic portion 54. These cyclonic portion 54 and the introducing portion 55 are formed integrally from a common member, while with a lower end of the introducing portion 55 being slightly lower than that of the cyclonic portion 54.

Further, the flange portion 21 of the vortex flow generating member 16 is placed in a step portion 54A between the first opening 52 and the cyclonic portion 54. Furthermore, a first receiving portion 56 which engages with the movable hook 8 is formed on a front side of the first opening 52 while a second receiving portion 57 which engages with the fixed hook 10 is formed on a rear side of the second opening 53.

Between the cyclonic portion 54 and the introducing portion 55 is vertically provided a rib 58 that is formed integrally with them, said vertical rib 58 being formed integrally with reinforcing ribs 59, 60 and 61 horizontally arranged. The rib 58 and the reinforcing ribs 59, 60 and 61 contribute to enhancing the stiffness of the dust-collecting portion 51. In the center of the lower end of the cyclonic portion 54 is integrally formed a rib-shaped leg 62, extending in an orthogonal direction relative to the rib 58 and the reinforcing ribs 59, 60 and 61. The leg 62 has a lower end formed flush with that of the introducing portion 55, such that a projection point G' obtained by projecting the center of gravity of the dust-collecting portion 51 in the vertical direction falls in a region A surrounded by the lower edge of the leg 62 and that of the introducing portion 55. Consequently, when the dust-collecting portion 51 is detached from the cleaner body 1, the dust-collecting portion 51 can stand on end owing to the introducing portion 55 and the leg 62. It should be noted that the structure of the dust-collecting portion 51 is simplified thus way. Incidentally, the nozzle 37 serving as a sucking nozzle is detachably attached to a lower end of the introducing portion 55.

Next is a description of the behaviors of the cyclonic vacuum cleaner of the second embodiment.

After cleaning, the nozzle 37 is detached from a lower end of the introducing portion 55 and then the dust-collecting portion 51 is detached from the cleaner body 1 by operating the movable hook 8. Then, the filter member 26 and the vortex flow generating member 16 are detached from the first opening 52 and the second opening 53, thus removing dusts adherent to the filters 24 and 25. The dusts collected in the cyclonic portion 54 are dumped into a trash box. At this moment, as the cyclonic portion 54 is formed integrally with the introducing portion 55 in the dust-collecting portion 51, not only can the dusts within the cyclonic portion 54 be easily dumped but also can those collected in the introducing portion 55 be easily removed with the light dust-collecting portion 51 being held by a hand. Accordingly, even if sheet-like matter or the like is sucked so that the introducing portion 55 or the introducing opening 19 is clogged therewith during cleaning, yet it can be easily removed.

Specifically, as the vortex flow generating member 16 having the introducing wall 18 is detachable from the dust-collecting portion 51 so that the introducing portion 55 penetrates from top through bottom when the vortex flow generating member 16 is detached, it is easy to remove those which clog the introducing portion 55, thus displaying excellent maintainability. Further, as the dust-collecting portion 51 is made of resin and is formed into one-piece structure, it can be washed with water, so that the cyclonic portion 54 and the introducing portion 55 can be kept cleaner through such wet-washing.

Moreover, as the dust-collecting portion 51 not only allows the cyclonic portion 54 to be integrally connected with the introducing portion 55 by the rib 58, but also it is reinforced by the reinforcing ribs 59, 60 and 61, the damage to the dust-collecting portion 51 can be prevented when detaching it from the cleaner body 1. Still further, as the dust-collecting portion 51 is reinforced by the rib 58, the reinforcing ribs 59,60 and 61, the dust-collection portion 51 can be prevented from being distorted or damaged during the use of the cleaner. Still also, the projection point G' obtained by projecting the center of gravity of the dust-collecting portion 51 in the vertical direction is positioned in the region A surrounded by the lower end of the leg 62 and the lower end of the introducing portion 55, so that the dust-collecting portion 51 is able to stand on end with the first opening 52 and the second opening 53 facing upward owing to the leg 62 provided at the lower end of dust-collecting potion 51 and the lower end of the introducing portion 55. Accordingly, it is possible to temporarily allow the dust-collecting portion 51 to stand on end without littering the floor with the dusts when dumping the dusts or the like, and thus it is very convenient. It should be noted that the dust-collecting portion 51 enables the dumping of the dusts with the nozzle 37 being attached to the lower end of the introducing portion 55, and that the dust-collecting portion 51 is able to be put on end with the nozzle 37 being attached to the lower end of the introducing portion 55.

As described above, a cyclonic vacuum cleaner according to the present embodiment comprises the cleaner body 1 with the motor fan unit 4 and the dust-collecting portion 51 detachably attached to the cleaner body 1, wherein the dust-collecting portion 51 comprises: the cyclonic portion 54 which is approximately cylinder-shaped, having a bottom; the introducing portion 55 for introducing dust-laden airflow into the cyclonic portion 54; the leg 62 provided on the lowermost end of the dust-collecting portion 51, said leg 62 allowing the dust-collecting portion 51 to stand on end; and the nozzle 37 serving as a sucking nozzle detachably attached to said introducing portion 55, wherein said cyclonic portion 54, said introducing portion 55 and said leg 62 are formed integrally with one another.

Hence, airflow sucked from the nozzle 37 is allowed to pass through the introducing portion 55 of the dust-collecting portion 51 to thereby be introduced into the cyclonic portion 54 formed integrally with the introducing portion 55, so that it is converted into a vortex flow within the cyclonic portion 54, whereby dusts are separated therefrom by centrifugal force and then the airflow passes through the motor fan unit 4 to be discharged to the outside of the cleaner body 1.

The dusts collected in the cyclonic portion 54 are dumped by detaching the dust-collecting portion 51 together with the introducing portion 55. Accordingly, not only can the structure of the cleaner body 1 be simplified despite the fact that a cyclonic vacuum cleaner tends to become too complex in structure, but the maintenance of the introducing portion 55 as well as that of the cyclonic portion 54 can be easily performed through the detachment of the dust-collecting portion 51 together with the introducing portion 55. Further, as the structure from the introducing portion 55 to the cyclonic portion 54 is simplified thus way and therefore the number of components can be decreased, it is possible to reduce the manufacturing costs, and to reduce the possibility of airflow leakage that might take place in a suction passage, thereby enabling the enhancement of the dust-collecting performance.

Still further, even if the dust-collecting portion 51 is temporarily laid down on the floor when users let go hold of it in the case of detaching it from the cleaner body 1 to dump the dusts contained in the cyclonic portion 54 or doing maintenance on the dust-collecting portion 51, yet the dust-collecting portion 51 can be allowed to stand on end by the leg 62, thus reducing the probability that the floor is littered with the dusts collected inside the cyclonic portion 54.

Still also, as the leg 62 has the lower end formed flush with that of the introducing portion 55, the dust-collecting portion 51 is able to be supported not only by the leg 62 but also by the lower end of the introducing portion 55, thus enlarging a support area for the dust-collecting portion 51, making it possible to keep the standing posture of the dust-collecting portion 51 more stably.

Specifically, the leg 62 of the cyclonic vacuum cleaner of the present embodiment is so structured that the lower end thereof is flush with that of the introducing portion 55, and that the point G' obtained by projecting the center of gravity of the dust-collecting portion 51 in the vertical direction may be positioned in the region surrounded by the lower edge of the leg 62 and the lower edge of the introducing portion 55. Thus, if users temporarily let go hold of the dust-collecting portion 51 in the case of detaching it from the cleaner body 1 to dump the dusts contained in the cyclonic portion 54 or doing maintenance on the dust-collecting portion 51, yet the dust-collecting portion 51 can be allowed to stand on end by the respective ends of the leg 62 and the introducing portion 55, thus keeping the dust-collecting portion 51 standing on end more stably, reducing the likelihood that the floor is littered with the dusts collected inside the cyclonic portion 54.

In the meantime, the present invention should not be limited to the foregoing embodiments but various modifications are possible within a scope of the invention. For example, although the lower end of the introducing portion extends lower than that of the cyclonic portion in the foregoing first embodiment, the lower end of the introducing portion may be flush with that of the cyclonic portion. Alternatively, the lower end of the cyclonic portion may extend lower than that of the introducing portion. Further, although the leg is formed on the lower end of the cyclonic portion in the second embodiment, it may be formed on the lower end of the introducing portion, or otherwise, on the rib which connects the introducing portion with the cyclonic portion.

What is claimed is:

1. A cyclonic vacuum cleaner including a cleaner body with a motor fan unit and a dust-collecting portion detachably attached to the cleaner body, wherein said dust-collecting portion comprises:

a cyclonic portion which is formed approximately cylindrical, having a bottom;

an introducing portion for introducing a dust entraining airflow into said cyclonic portion;

a leg provided integrally with a lowermost end of said dust-collecting portion for allowing said dust-collecting portion to stand on end; and a sucking nozzle detachably attached to said introducing portion, wherein said cyclonic portion, said introducing portion and said leg are formed integrally with one another.

2. A cyclonic vacuum cleaner according to claim 1, wherein said leg is formed by a reinforcing rib which connects said cyclonic portion with said introducing portion, said reinforcing rib being so structured that at least a lower surface thereof being formed substantially horizontal, and that a projection point obtained by projecting the center of gravity of said dust-collecting portion in the vertical direction may be positioned on said reinforcing rib.

3. A cyclonic vacuum cleaner according to claim 1, wherein a lower end of said leg is flush with a lower end of said introducing portion.

4. A cyclonic vacuum cleaner according to claim 2, wherein a lower end of said leg is flush with a lower end of said introducing portion.

5. A cyclonic vacuum cleaner according to claim 1, wherein a lower end of said leg is flush with a lower end of said introducing portion and that of said cyclonic portion.

6. A cyclonic vacuum cleaner according to claim 2, wherein a lower end of said leg is flush with a lower end of said introducing portion and that of said cyclonic portion.

7. A cyclonic vacuum cleaner according to claim 1, wherein a lower end of said leg is flush with a lower end of said cyclonic portion.

8. A cyclonic vacuum cleaner according to claim 2, wherein a lower end of said leg is flush with a lower end of said cyclonic portion.

9. A cyclonic vacuum cleaner according to claim 3, wherein a lower end of said leg is flush with a lower end of said introducing portion while a projection point obtained by projecting the center of gravity of said dust-collecting portion in the vertical direction is positioned in a region surrounded by the lower end of said leg and the lower end of said introducing portion.

10. A cyclonic vacuum cleaner according to claim 5, wherein a lower end of said leg is flush with a lower end of said introducing portion while a projection point obtained by projecting the center of gravity of said dust-collecting portion in the vertical direction is positioned in a region surrounded by the lower end of said leg and the lower end of said introducing portion.

11. A cyclonic vacuum cleaner according to claim 1, wherein a vertical rib is integrally formed between said cyclonic portion and said introducing portion.

12. A cyclonic vacuum cleaner according to claim 2, wherein a vertical rib is integrally formed between said introducing portion and said cyclonic portion.

* * * * *